United States Patent [19]

Shoglow

[11] 4,373,724

[45] Feb. 15, 1983

[54] FAMILY BASEBALL GAME

[76] Inventor: Harry Shoglow, 4200 Lee Hwy., Arlington, Va. 22207

[21] Appl. No.: 174,934

[22] Filed: Aug. 4, 1980

[51] Int. Cl.[3] ..... A63F 7/06; A63F 7/24; A63F 7/30; A63B 63/04

[52] U.S. Cl. ..... 273/89; 124/16; 273/399; 273/401

[58] Field of Search ..... 273/398-402, 273/88-90, 129 P; 124/16, 17, 24, 25; 116/222, 319

[56] References Cited

U.S. PATENT DOCUMENTS

| | | | |
|---|---|---|---|
| 566,134 | 8/1896 | Buffat | 273/402 |
| 1,187,995 | 6/1916 | Jerram et al. | 273/399 X |
| 1,341,628 | 6/1920 | Bourne | 273/90 |
| 2,224,962 | 12/1940 | Hines | 273/400 |
| 2,478,429 | 8/1949 | Sinclair | 273/129 P X |
| 3,100,642 | 8/1963 | Goldstein | 273/88 X |
| 3,220,127 | 11/1965 | Wilson | 116/222 X |
| 3,246,411 | 4/1966 | Aafedt | 116/222 |
| 3,355,173 | 11/1967 | Selker | 273/89 |
| 3,913,915 | 10/1975 | Carmen | 273/88 |

FOREIGN PATENT DOCUMENTS

| | | | |
|---|---|---|---|
| 566245 | 8/1957 | Italy | 273/401 |
| 21781 | of 1903 | United Kingdom | 273/399 |

*Primary Examiner*—Paul E. Shapiro

[57] ABSTRACT

A game which may be sold as a packaged unit and is provided with means for projecting a ball by ejection in a direction and with a velocity controlled by the player and wherein the ball is directed at a given target representing a baseball field. The target toward which the ball is ejected by the player is mounted on one flap of a carton and has a number of ball receiving openings toward which the ball is aimed, wherein each opening is a scoring unit and between the front of the opening and the rear wall are spaces to retain the balls for tabulating at the end of the half inning. In the event the ball doesn't enter an opening it will drop to the bottom of the game into one of severally marked troughs and register another chance score. A prop is used to hold the target in an upright position facing the open carton. For storage the prop is removed and the carton flaps are held in an overlapping closed position by clips.

1 Claim, 12 Drawing Figures

FAMILY BASEBALL GAME

This invention relates to packaged games of the type simulating a baseball game, named "SHO-GLOW FAMILY BASEBALL," to be played by two players and the score is kept in the manner of scorekeeping during a baseball game.

It is one of the objects of this invention to provide a game which can be sold as a packaged unit and it is provided with means for projecting a ball in a direction and with a velocity controlled by the player and wherein the ball is directed at a given target representing a baseball field and wherein the score is kept in a manner similar to the keeping of the score in a professional baseball game.

In accordance with the preferred embodiment of the is provided which could be manually aimed toward the target and the ball receiving openings, these openings are scored, for example "HOME RUN"-"1 BASE HIT"-"3 BASE HIT"-"FOUL OUT" and "FLY OUT", etc, as in baseball. In the event that the ball fails to enter any ball receiving openings it drops to the bottom of the container to four chance troughs, two of them indicate "STRIKES" and the other two indicate "BALLS".

In accordance with the prefered embodiment of the present invention, the target at which the balls are directed has several compartments in the rear of the printed holes which will retain any ball which enters the ball receiving holes and remains there until the end of the inning. To retrieve the balls, the target is turned face downward and the balls fall to the bottom of the container when the prop is released. Be cause of the provision of several compartments for the ball receiving holes, it is easy to check on the question as to whether the ball entered one hole or another, indicating whether the player made a "1 base hit" or any other score.

In accordance with this invention, it is a still further object to provide an ejector, to eject a ball toward a target, as mentioned above which is made of several component parts, A flat piece of thin material, a spring, a wire retracter and a handle for swivelling and aiming. The wire retractor has trunnions at its two ends which is attached to the spring to retract it and force it to rebound to send the ball on its way to the target. The ejecter is held by one hand and the other hand manipulates the wire retracter. By this arrangement the player has a simple way to swivel the ejector in any direction.

The attainment of the above and further objects of this invention will be apparent from the following specification taken in conjunction with the accompaning drawings forming a part thereof.

Figure 4:
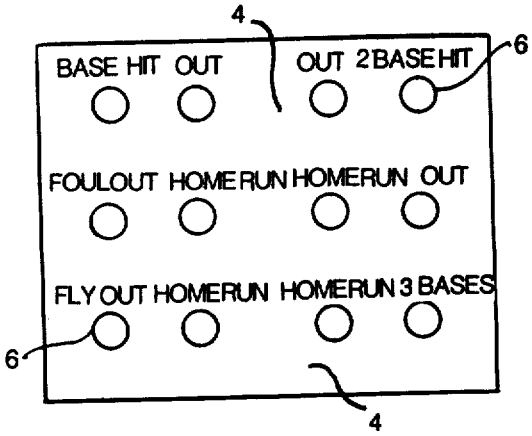
Figure 5:
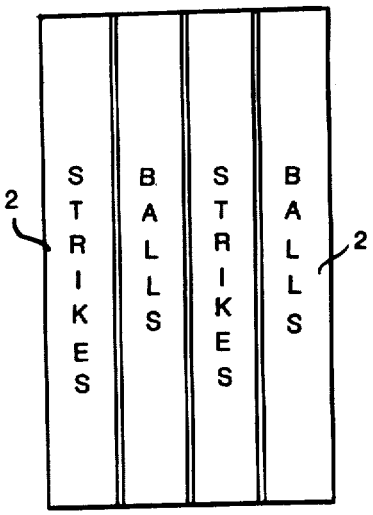
Figure 6:
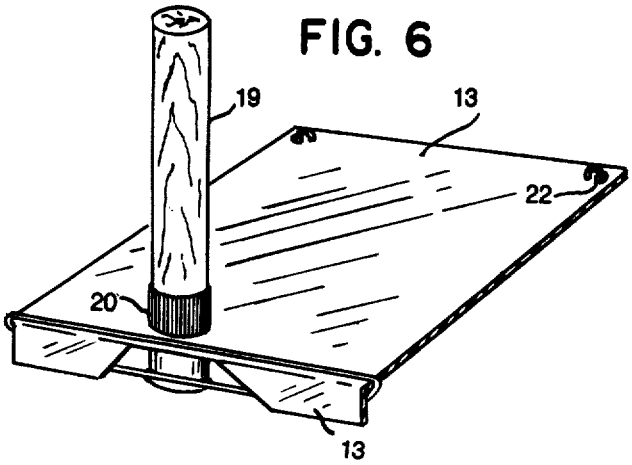
Figure 8:
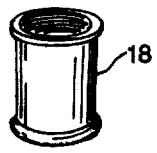
Figure 7:
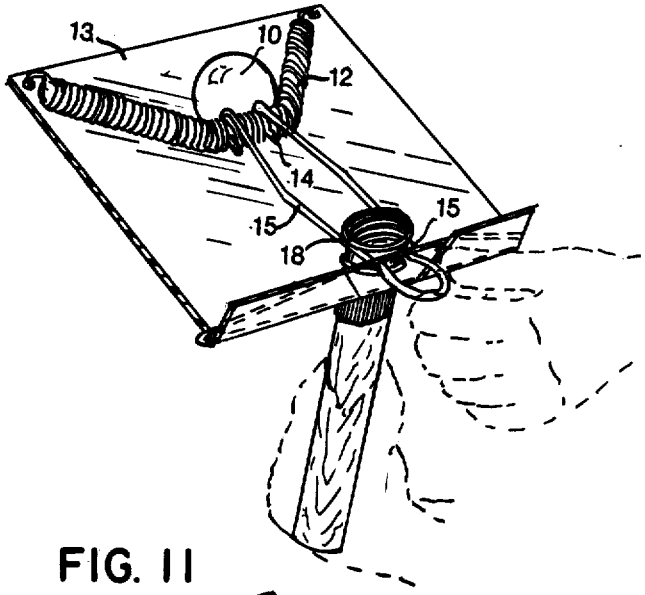
Figure 9:
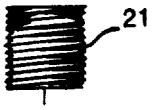
Figure 10:
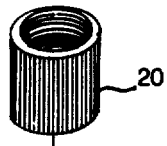
Figure 11:
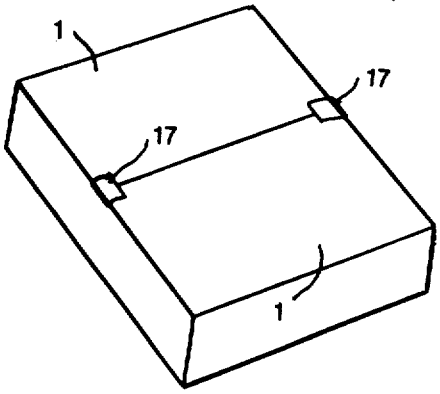
Figure 12:
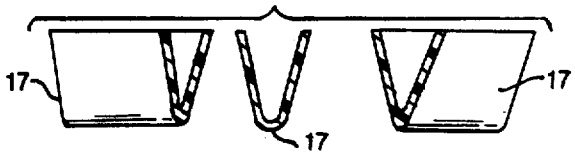

FIG. 4 is a view of the face of the target with the holes and printed matter, FIG. 5 is a view of the bottom of the container designating "balls" & "strikes", FIG. 6 is a view of the rear of the ejecter with the handle attached to it, FIG. 7 is a view of the front of the ejector with the spring, wire retracter, barrel connecter to the handle and a ball, FIG. 8 is a view of the connecting barrel with the inside threads, FIG. 9 is a view of the spiralling thread which connects the ejector to the handle, FIG. 10 is a view of the threaded connection of the handle to the ejector, FIG. 11 is a view of the container closed and the clamps securing the top flaps, FIG. 12 is a view of the clamps that hold the front and side flaps to the container while the game is being played and also to secure the container.

Reference may now be had more particularly to the drawings wherein like reference numerals designate like parts throughout.

The game of the present invention is indicated in general by the numeral 1:

The game 1 has a boxlike structure of pasteboard, cardboard, metal or plastic, wood or the like, having a bottom 2 has scoring elements designating "BALLS" and "STRIKES". The container 3*a* of the game 1 could be either of longitudinal or square shape and has four flaps 3. The target 4 which is attached to an inside flap 3 can also be made of the same material of the container 3*a*. When the inner flap 3 is lifted it also elevates the target 4. A prop 5 is provided to keep the target 4 elevated. The prop 5 is removed by unscrewing it from the target's 4 bottom which has a spiralling thread 21 to connect with the fitting with an inner thread 20 that is located on the top of the prop. The prop 5 can be made of metal, wood or plastic and the fittings, metal or plastic.

Figure 1:
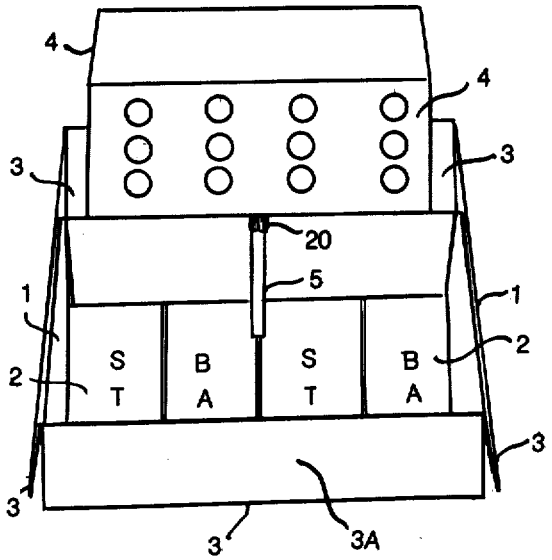
FIG. 1 is a perspective view of a game embodying the present invention.
Figure 2:
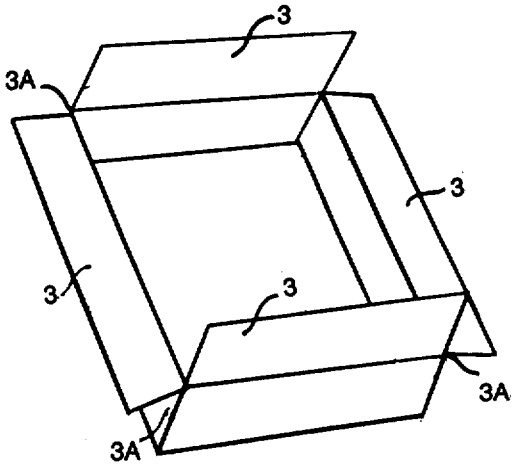
FIG. 2 is a view of the game's container with the four open flaps.
Figure 3:
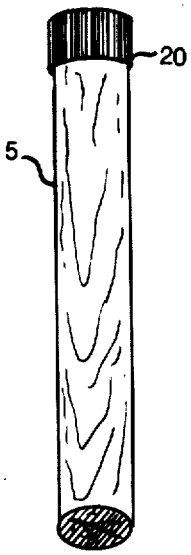
FIG. 3 is a view of the prop that holds the target upright.

As illustrated in FIG. 1 the front of the target 4 has several holes 6 for scoring, ajacent to the holes 6 is printed matter identifying the different scoring values. The printed matter is in accordance with the rules of organised baseball. The center 4 holes 6 are designated as "HOME RUN" and the other holes as "1-2 or 3" base hits, "FOUL OUT," "BUNT OUT", etc. On the inside of the target 4, there is a compartment for each scoring hole 6, it is made by interlocking several length of material creating pockets, or compartments, they are provided for receiving balls 10 and retaining them until they are retrieved.

During the operation of the game 1, a player holds an ejector 13 in one hand and places a ball 10 in the "V" 14 of the spring 12 and with the other hand retracts the spring 12 by pullng the retracter 15, a thick piece of wire, it will retract and then recoil, hitting the ball 10 to send it on its way to the point on the target that is aimed at. The fitting 18 with inside thread connects the ejector 12 to the handle 19.

When the game 1 is ended and it is desired to close the package to be stored until used again, the prop 5 is released, the flap 3 with the target 4 is lowered to its usual closing position and after the scorekeeper 7, the balls 10 and the ejector 13 are deposited in the container 3*a*, the clamps 17 are to be removed from the sides and front of the container 3*a*, completing a self cover and two of the clamps 17 will secure the container 3*a* by being attached to the two top sides, as shown in FIG. 1. Before the container is secured the three clamps 17 are deposited in the container 3*a*.

While I have herein described a game wherein the major parts thereof are made of paper and paper products, it is to be understood, that the materials from which the game is made, do not constitute the essance of the present invention and that the structure may be made of materials specifically different from paper or paper products, by way of illustration and not by way of imitation, the structure may be made of wood, metal or any known plastics, or the like.

In compliance with the patent statutes, I have here shown and described one embodiment of my invention, it is however understood, that the invention is not limited to the precise construction here shown, the same being illustrative of the principles of the invention.

I consider this game new and useful and desire to secure a United States Patent.

I claim:

1. A packaged baseball game comprising a container having sides and a bottom a flap secured to each side movable between a container closing position and a container opening position, a target secured to one of said flaps on the side thereof facing said bottom when said flap is in its container closing position, said target comprising a plurality of scoring apertures therein, and baseball scoring indicia adjacent said apertures, a prop means engageable with said target for holding said target in an upright position with said apertures facing outwardly overlooking said bottom, said bottom comprising a plurality of troughs and further baseball scoring indicia in said troughs, and an ejector for propelling balls toward said target comprising, a flat disc, a spring secured at opposite ends to spaced points on said disc, a handle secured to said disc for manipulating and aiming said ejector and a wire secured to said spring intermediate said ends for retracting said spring.

* * * * *